United States Patent [19]

Boardman

[11] 4,040,601

[45] Aug. 9, 1977

[54] FENCE POST REMOVER

[76] Inventor: Robert William Boardman, 22742 Yosemite Blvd., Waterford, Calif. 95386

[21] Appl. No.: 742,452

[22] Filed: Nov. 17, 1976

Related U.S. Application Data

[63] Continuation-in-part of Ser. No. 709,213, July 27, 1976, abandoned.

[51] Int. Cl.[2] ..... B66F 3/00

[52] U.S. Cl. ..... 254/133 R; 254/30

[58] Field of Search ..... 254/30, 31, 132, 133

[56] References Cited

U.S. PATENT DOCUMENTS

| | | | |
|---|---|---|---|
| 697,625 | 4/1902 | Mogenson | 254/31 |
| 1,916,463 | 7/1933 | Carrel | 254/132 |
| 2,807,494 | 9/1957 | Bulfer | 254/132 |
| 3,762,687 | 10/1973 | De Rome et al. | 254/30 |

*Primary Examiner*—James L. Jones, Jr.
*Assistant Examiner*—Robert C. Watson
*Attorney, Agent, or Firm*—J. L. Bohan

[57] ABSTRACT

A device for the extraction of metal fence posts having a T-shaped cross-section. The device is designed so as to engage the lugs located on the face of the fence post so that an upward application of force on the device will dislodge the fence post.

6 Claims, 2 Drawing Figures

FENCE POST REMOVER

CROSS-REFERENCE TO RELATED APPLICATION

This is a continuation in part of an application filed on July 27, 1976 Ser. No. 709,213, now abandoned. The parent application was entitled, "POST-PULLING ATTACHMENT FOR METAL FENCE POSTS," which application was filed in the name of Robert William Boardman.

BACKGROUND OF THE INVENTION

1. Field of the Invention

The present invention relates to ranch and farm equipment and more particularly to a device which may be used manually or in conjunction with power equipment for the removal of metal fence posts.

2. Description of the Prior Art

A widely used type of fence post is a metal post having a T-shaped cross-section containing solid lugs on the face of the T distributed evenly along the length thereof for the purpose of supporting strands of wire. The lower end of the post is designed with a pointed end to facilitate driving of the post into the soil and an anchor plate somewhat above said point to maintain alignment of the post during driving, and to prevent working the post back and forth so as to enlarge the hole thereby causing the post to be easily worked out by the animals or the elements. It is by virtue of the anchor plate and the depth to which the post is driven that causes the extraction to be extremely difficult without bending or otherwise damaging or defacing the fence post. A number of devices and apparatus have been created in the past for the purpose of removing metal fence posts. For example, there is shown in U.S. Pat. No. 2,807,494, issued to J. F. Bulfer, Jr., on Sept. 24, 1957. The design of this unit, as in the case of many other units, is such as to maximize the biting of the edges of the device into the metal post. This provides a firm grip on the post allowing its removal by an upward application of force on the device such as by means of a draw bar on a three-point hydraulic lift tractor. Another device relying upon the binding effect created when a sharp edge of the device bites into the metal post is that shown in U.S. Pat. No. 3,762,687, issued to Eugene J. De Rome, et al, on Oct. 2, 1973. The difficulty with metal post removing devices of this general design which rely upon a sharp edge of the device biting into the fence post, is that these edges eventually wear down reducing the biting capability of the device to the point of causing it to fail to grip or slip dangerously during the extraction process. Such devices will work well when they are new and the edges on the device are sharp, but eventually these edges become dull and must be replaced. In addition, because of the point force applied to the relatively mild steel from which the fence post is fabricated, creates sharp burrs on the post which are hazardous to the operators. Another prior art device for removing fence posts is disclosed in U.S. Pat. No. 1,916,463, issued to F. G. Carrel, on July 4, 1933. As in the other prior art devices mentioned above, the Carrel device likewise provides an apperture having edges which are substantially normal to the surface of the device, thereby when the device is slipped over the post and forcefully applied against the post in an upward manner, the sharp edges come into contact with the front and back portions of the post thereby creating the biting effect referred to above. Although the drawings show the unit being used so that the lugs on the post are engaged, the device relies upon the two-point bite approach thereby creating burrs on the fence post as well as eventually wearing out the biting surfaces on the tool. Such devices, moreover, by virtue of the two-point contact, create a bending moment which can cause the post to bend. Although in most cases such bends are quite small, if the posts are to be reused, even a slightest degree of angularity will create serious problems in reconstructing a straight, taut fence line.

The above are simply exemplary of the prior art showing the various metal fence post extracting devices. It is an object, therefore, of the present invention to provide a fence post remover which does not rely upon point contacts to create a bite, but relies upon the application of forces over a comparatively larger area thereby minimizing wear on the device itself, substantially reducing the tendency of the post to be bent and to require a minimum of energy to remove the post since the force vectors created in its use are primarily along the axis of the post and very little counteracting transverse forces are created causing a bending movement on the post.

SUMMARY OF THE INVENTION

A preferred embodiment made in accordance with the principles of the present invention utilizes a metallic body having a cross-bar with an inside face which comes into substantially flat contact with the underside of the lug on the face of the fence post. Side flange members which extend from the termini of the cross-bar and meet at a point to the rear of the fence post have a substantially thick vertical cross-section to maximize the area of contact with the back side of the stem portion of the T-shaped post. The portion of the device which extends beyond the back side of the post contains a concave underside so that if the device is driven out manually by means of a pipe, the pipe will be automatically directed to apply maximum force at a point relatively close to the back side of the post thereby minimizing the bending moment.

In order to more fully describe the various aspects of this invention, the following drawings and descriptions explain the various features and aspects of the device.

DETAILED DESCRIPTION

Figure 1:
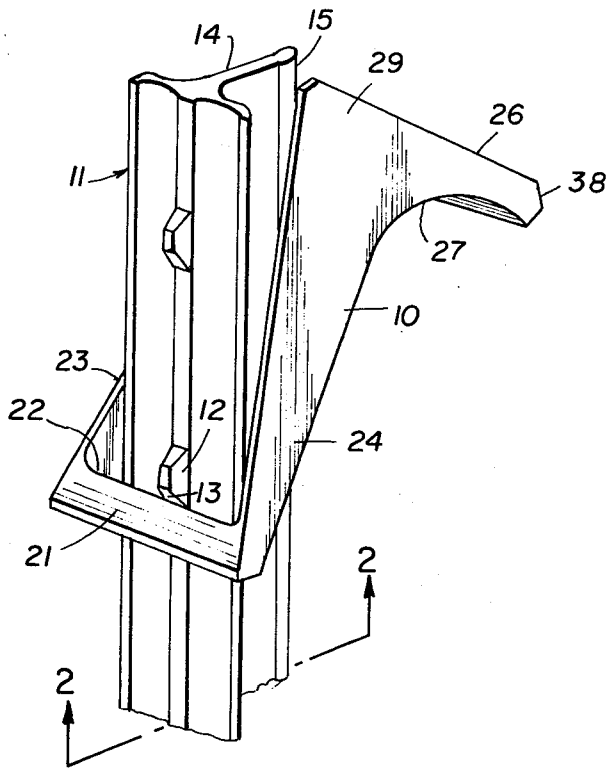
FIG. 1 is a perspective view showing the fence post puller engaged with a metal fence post.

Referring by numerals to the accompanying drawings, which illustrate a preferred embodiment of the device, in FIG. 1 the fence post remover 10 has been placed over the top of the fence post 11 and lowered to a point so that one of the lugs 12 is engaged on its lower face by the cross-bar 21 of the device. The inside surface 22 of cross-bar 21 is substantially flat so that surfaces 22 and 13 join over a relatively large area so as to minimize any possibility of a point contact. The ends of the cross-bar converge into two side flange members 23 and 24 which extend upwardly and rearwardly to join at a point to the rear of the fence post 11. The fence post 11 which is T-shaped in cross-section contains a stem portion 14, having edge portion 15.

Figure 2:
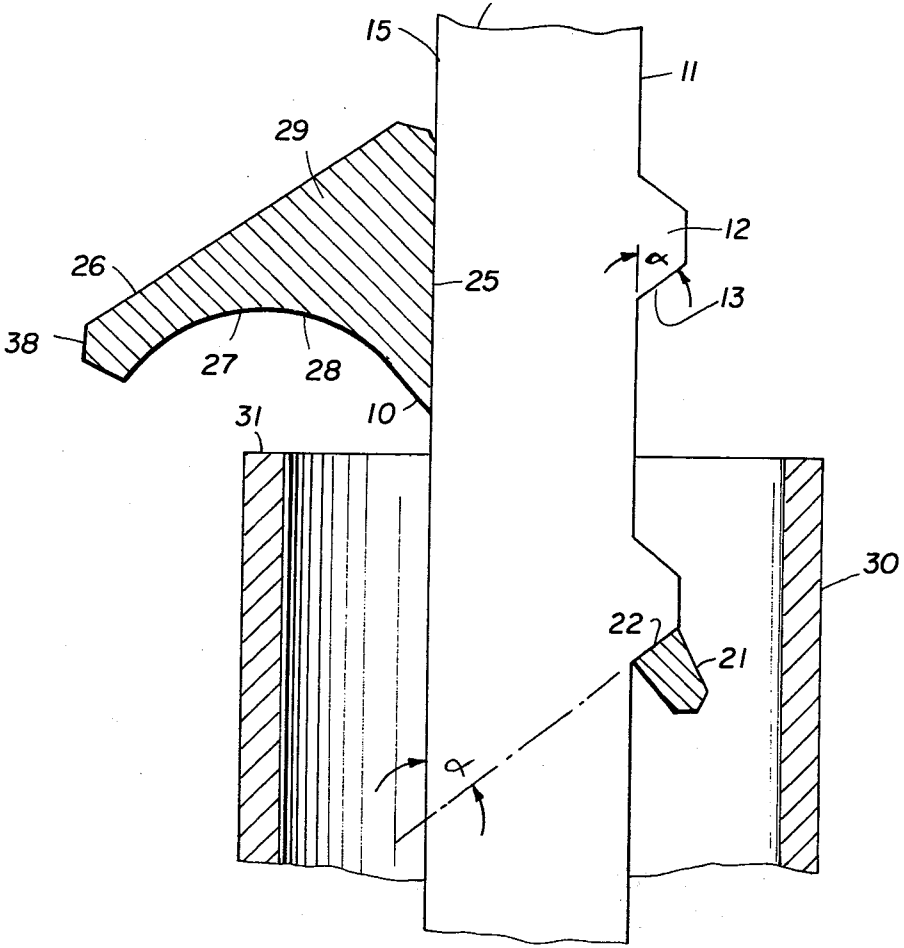
FIG. 2 is a cross-sectional view along line 2—2 of FIG. 1 showing the inner relationship of the device with the components of the fence post.

Referring now to FIG. 2, the point of convergence of flange members 23 and 24 are more clearly shown in the cross-sectional view wherein they converge forming the apex of the opening having substantial cross-section vertically along the back of the pipe. This point of juncture creates a large surface area 25, which, upon use of the device, will apply a force over the large surface area of the back edge 15 of the fence post. Member 26 of the device is of substantial cross-section and distends downwardly and away from the high point of contact of the device with the back portion 15 of the post. The under surface of this member 27 is substantially flat so as to fully engage any device which is applying an upward force on the unit. For example, if a pipe 30 is used to manually apply an upward force, it is desirable to have surface 27 to be of a concave arcuate surface so that if edge 31 of the pipe tends to be too far rearward, it will tend to automatically slide inwardly to center at approximately point 28 so that the force is applied relatively close to the back side 15 of the fence post, thereby creating a minimum of a bending moment.

When force is applied to the device 10 at approximately point 28 on the underside of member 26, the upward portion of the device 10 is forced in a clockwise direction causing an engagement of the surface 25 over substantially all of its length against the back of the fence post at 15. Cross-bar 21 is likewise forced in a clockwise direction forcing it as close as possible to the face of the fence post. The energy involved in the rotation of the unit 10 is quite minimal, and the maximum thrust of the force is applied through the central body portion 29 of the unit and then through the flange members 23 and 24 down to the face 22 of cross-member 21. Accordingly, the vast majority of the energy applied at point 28 eventually becomes an application of force at point 13 at the bottom of lug 12, imparting a substantial vertical component of force to the fence post thereby dislodging it. Little or no force is applied by virtue of contact between surface 25 of the device and the back edge 15 of the fence post. The unit 10 and the fence post 11 are in a sliding relationship where 25 contacts 15 and not in a biting or binding contact. This unique effect produces a very powerful lifting component at point 13 on lug 12, producing a highly effective lifting and dislodging force on the fence post.

An important design aspect of the present invention relates to the angle alpha created between the plane of the face of the post and the bottom surface 13 of the lug 12. In order to create the application of forces over large surface areas at points 22 and 25 of the device against surface 13 and 15 of the fence post, it is necessary that the plane of surface 22 intersect the plane of surface 25 at substantially the same angle alpha.

The unit 10 is preferably made of a high quality metal such as an alloy steel. It is highly desirable to produce hardened surfaces in areas 22 and 25 of the device 10. Since these are not areas of point contact, but are areas where load is distributed over a comparatively large area, there are no sharp edges to wear out and the unit will have an extremely long, useful life. The unit may be constructed in one piece by means of casting or forging or can be assembled by means of welding or otherwise joining the components so as to incorporate the embodiments of the invention. Due to its relatively small size and light weight, it can be readily carried in a field so that it is particularly useful in rough terrain where no equipment can be brought in for use. Due to the uneven ground often a post will be driven into the ground at a wrong angle and the post will need to be removed and reset. With a pipe or hollow cylinder driver with a removable plug or cap, it can double as a manual driving unit for removing a fence post with the device 10 of the present invention. Although the unit 10 can be held in place manually while an operator is forcing cylinder 31 in an upward direction, or appropriate equipment is applied to the unit 10 to supply the upward force, means can be readily provided to hold the unit to the pipe. For example, a simple rubber band can be placed on face 38 of the unit and around to the other side of the post 11 so as to hold in place during the driving operation. Obviously, numerous alternatives may be used to hold the unit in place during the driving and removal operation, such as, drilling holes in the unit or providing it with eyelets for attaching wires, springs or other tightening devices for holding it tight to the post 11. Due to the design of the item, it is provided with thick cross-sections in the areas where it needs high modulus and thin cross-sections where appropriate clearances are needed. However, it is obvious that if a light-weight design is not essential, these exact physical features may be varied. Because of the sturdy construction of the unit, it is strong enough for repeated use with power equipment for commercial applications. Accordingly, the device of the present invention is extremely flexible in that it may be used for manual as well as power applications in a highly efficient and effective manner with little or no damage to the fence post.

Although there has been shown and described a particular embodiment of this invention, it will be obvious to those skilled in the art that various changes and modifications may be made therein without departing from the invention.

I claim:

1. A device for removing from the ground a metal fence post of the type being substantially T-shaped in horizontal cross-section with uniformly spaced lugs on the face of the T, each said lug defining a predetermined angle to said face; said device having a cross-bar of substantial thickness and an inner face, said cross bar forming an opening in conjunction with two flange members which converge forming an apex having substantial cross-section so as to form a relatively long juncture along the vertical axis, a member of substantial cross-section distending downwardly and away from the apex on the side opposite said flanges with the lower terminus thereof forming a substantially flat, concave surface with the lower surface of said flange.

2. A device as in claim 1 wherein said opening formed by the cross-bar and the two flange members is wider in the area of the cross-bar than the face portion of said fence post and deeper than the stem portion of said T-shaped fence post.

3. A device as in claim 2 wherein the inner face of said cross-bar is substantially flat in a plane that intersects the plane of the relatively long juncture of the flange members at an angle substantially identical to said predetermined angle of the lug to the said face of the fence post.

4. A device as in claim 3 wherein the concave surface is substantially arcuate.

5. A device as in claim 4 wherein the material from which the device is fabricated is of substantially greater hardness along the inner face of said cross-bar and along said arcuate surface.

6. A device as in claim 5 wherein the overall external width of the device in the area of the cross-bar member is less than the inside diameter of a hollow metal cylinder of substantial weight which can be manually raised and lowered so as to impact the upper edge thereof with the arcuate surface on the underside of said distending member.

* * * * *